US007049795B2

(12) United States Patent
Beckwith

(10) Patent No.: US 7,049,795 B2
(45) Date of Patent: May 23, 2006

(54) UNDERLOAD TAPCHANGING VOLTAGE REGULATORS FOR EASE OF FIELD REPLACEMENT AND FOR IMPROVED OPERATOR SAFETY

(76) Inventor: Robert W. Beckwith, 2794 Camden Rd., Clearwater, FL (US) 33759

( * ) Notice: Subject to any disclaimer, the term of this patent is extended or adjusted under 35 U.S.C. 154(b) by 44 days.

(21) Appl. No.: 10/837,994

(22) Filed: May 3, 2004

(65) Prior Publication Data

US 2005/0104567 A1 May 19, 2005

Related U.S. Application Data

(60) Provisional application No. 60/478,195, filed on Jun. 13, 2003.

(51) Int. Cl.
*G05F 1/16* (2006.01)

(52) U.S. Cl. ..... 323/258; 323/264

(58) Field of Classification Search ..... 323/255, 323/258, 259, 262, 263, 264
See application file for complete search history.

(56) References Cited

U.S. PATENT DOCUMENTS 5,408,171 A * 4/1995 Eitzmann et al. ..... 323/258
5,804,954 A * 9/1998 Laplace, Jr. ..... 323/256
6,833,518 B1 * 12/2004 Byers et al. ..... 200/11 TC

* cited by examiner

*Primary Examiner*—Gary L Laxton
(74) *Attorney, Agent, or Firm*—Leo J. Aubel

(57) ABSTRACT

Under load tapchanging voltage regulators with source and load connections, series and shunt transformers, switching devices for causing selectable levels of electric power to flow in either direction between the series and shunt transformers, and tapchanger controls for sensing the voltage at said load connections and causing the switching devices to select proper electric power flows so as to maintain desired voltages at the load connections.

16 Claims, 13 Drawing Sheets

TAP SWITCH

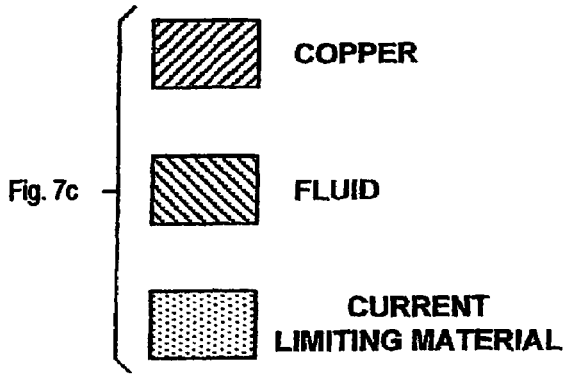
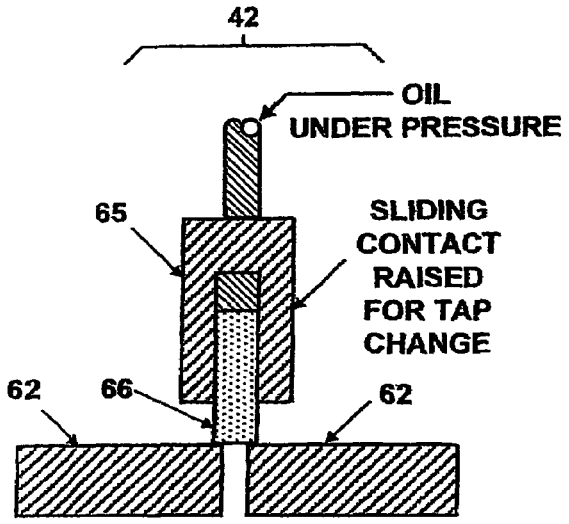
Fig. 7a
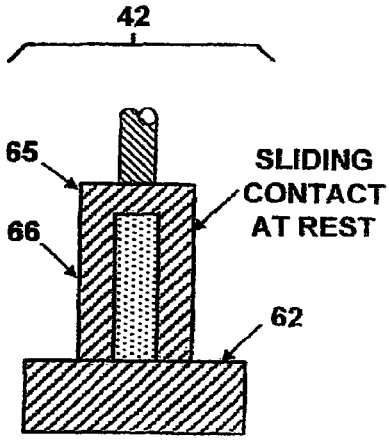
Fig. 7b
SLIDING CONTACT

DRY TYPE
REGULATOR CONTROL

OIL FILLED
REGULATOR OUTLINE

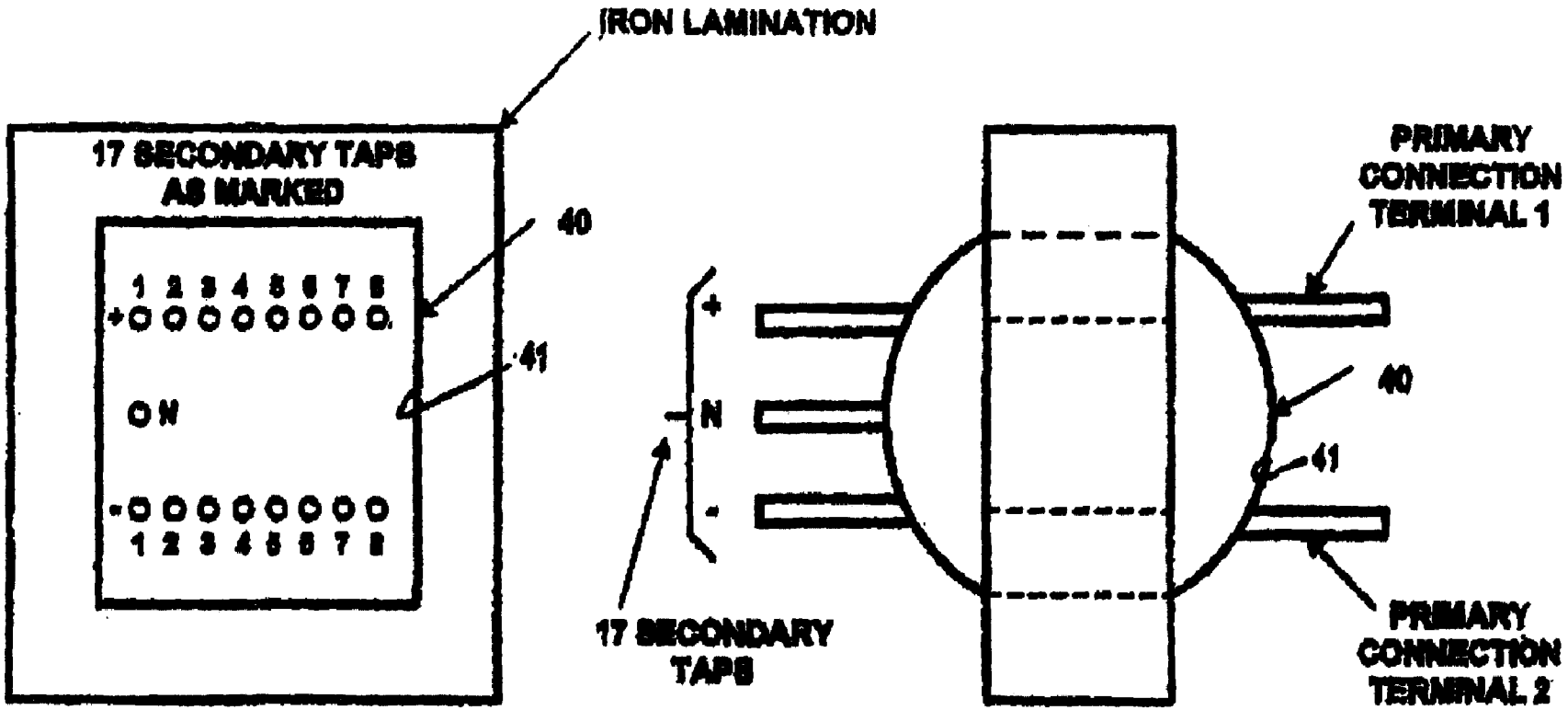
Fig. 10b SIDE VIEW
Fig. 10a TOP VIEW
SERIES TRANSFORMER

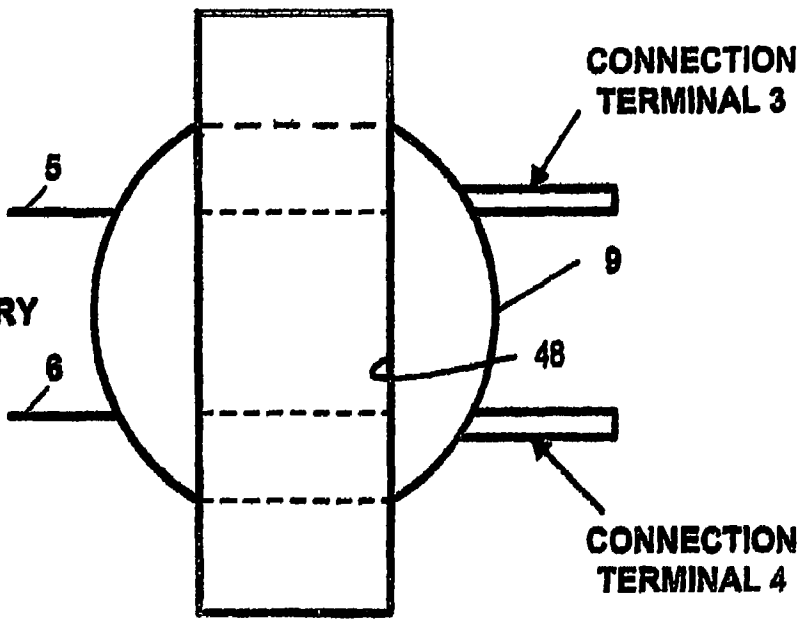
Fig. 11a SIDE VIEW
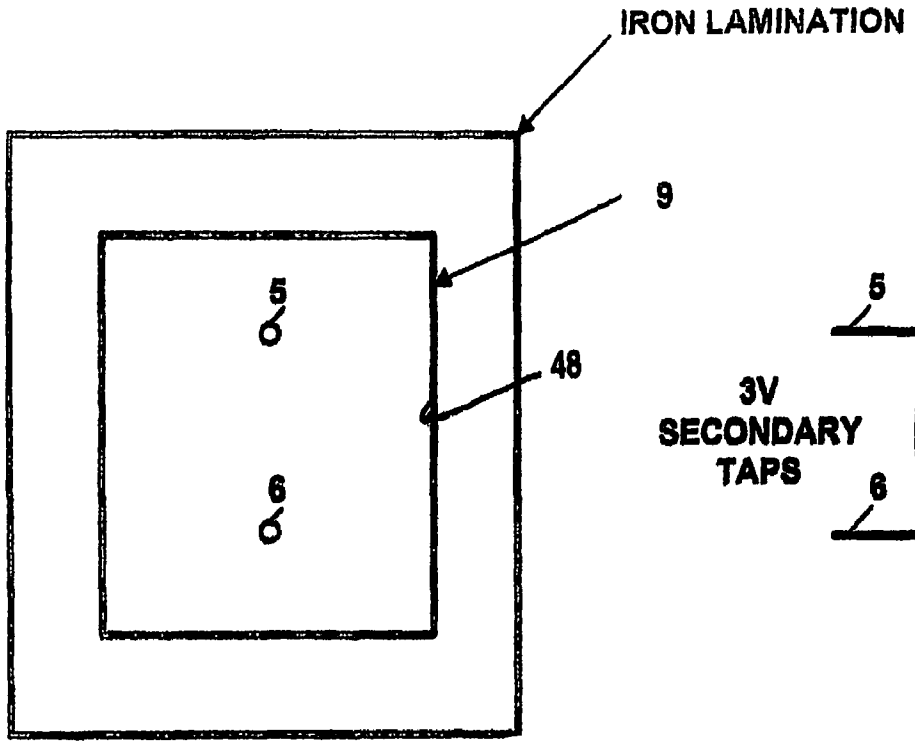
Fig. 11b TOP VIEW
SHUNT TRANSFORMER

TAPCHANGER CONTROL DEVICE

UNDERLOAD TAPCHANGING VOLTAGE REGULATORS FOR EASE OF FIELD REPLACEMENT AND FOR IMPROVED OPERATOR SAFETY

This patent application claims the filing date of provisional patent application Ser. No. 60/478,195 of Robert W. Beckwith, filed on Jun. 13, 2003. The title has been changed.

PRIOR ART BACKGROUND OF THE INVENTION

Tapchanging voltage regulators providing a regulating range of +/−10% are used on single and three phase power distribution lines. Some electric power distributions substations use sets of three regulators on three phase distribution lines as they leave the substation. Usually each regulator is supplied by a single phase transformer for reducing the voltage from that of the substation primary feed to the voltage of the regulator. Regulators so applied are referred to as "station regulators".

Other substations supply voltage reduced by a single three phase transformer feeding lines from a distribution substations to users of electric power. Such transformers have taps on the winding switched by a tapchanging switch. Control devices for such switches are known as Load Tapchanging (LTC) Controls. Such devices control all three phase voltages based on sensing but one of the three phases.

In either instance line regulators are used along single and three phase distribution lines which extend from distribution substations for re-regulating the voltage where required. Regulators are often referred to as "station" or "line" regulators depending on their location even though they may be identical in construction.

Regulators are also used in large industrial complexes to regulate voltages to compensate for varying processing loads. To reduce the fire hazard of oil filled regulators there is a need for dry type regulators to regulate voltages in very tall buildings.

Prior art regulators generally use an autotransformer with 16 steps for raising and 16 steps for lowering the voltage by up to 10%. The steps are changed by a motor driven tapswitch. The 16 steps are derived from eight transformer taps using a bridging autotransformer to form a voltage step midway between each pair of autotransformer taps.

For economy of autotransformer construction, prior art regulators often use a single eight tap winding that is reversed so as to either raise or lower voltages by a combination tapchanging and winding reversal switch. Improvements in cost realized from polarity reversal may be partially offset by increased switch cost of the switch and the need for a larger switch drive motor. In the construction of either LTC transformers or regulators the transformer and switch are housed in a tank filled with oil.

To enable changing a regulator for maintenance without shutting off power, it is necessary to place the regulator in neutral and bypass the regulator. The bypass is accomplished by a lineman either using a temporary jumper cable or by operating a permanently mounted by pass switch operated by an insulated hook switch. Tanks have been known to explode with deadly results when a bypass cable was installed when the regulator was not truly on neutral and the lineman was not in a safe location.

This prior art material together with non-inventive FIGS. 1, 2 and 3 are included for reference only to describe presently accepted practice. FIGS. 1, 2 and 3 are useful in describing the inventive regulator in its departure from prior art practice.

FIG. 1, labeled prior art, shows an outline of a General Electric Type VR-1™ regulator which uses a Beckwith Electric M-2001 control branded for General Electric. Note in particular the prior art voltage step indicator with drag hand reset. These indicate the present position of the regulator step position together with the maximum and minimum step position since the last time the drag hands were reset manually. The source and load connection terminals are shown together with a neutral terminal. While the neutral terminal is often connected to ground when installed there are instances where it is not. The control box is shown mounted on the regulator. Line regulators are typically mounted at power line height on platforms constructed between two poles. The controls may be mounted at ground level for ease of access without use of a bucket truck.

FIG. 2, labeled prior art, show the front panel of a Beckwith Electric model M-2001 control, marked for GE, as seen with the control box door open. The control marked GE-2011 has a display at the top. Pushbuttons marked U for up and D for down move items on the display. When a desired item is displayed it may be entered by pressing the pushbutton marked E.

An RS232 "COM2" port is shown for connecting a computer with a user interface program for such things as entering setpoints and obtaining historic and present data.

LEDs light to indicate the tapchanger motor operating to "RAISE" the tap position and another to indicate operation to "LOWER" the tap position. Power may flow in reverse through the regulator to nearby loads from a power feed at the end of a distribution line. When this happens the "REV PWR" LED lights. An "OK" LED lights when power is on and the control is operating properly as determined by self checking features of the control.

In FIG. 2 five panels to the right are as follows:

1. Panel 1 has three fuses. The first fuse labeled "TEST TERMINAL" is for the meter out banana jack terminals. The second fuse labeled "VOLTAGE" is for the voltage out banana jack terminals. The third fuse labeled "MOTOR POWER" for the motor power banana jack terminals. The banana jack terminals are all shown in the second panel.
2. Panel 2 has three sets of banana jack terminals: "VOLTAGE IN", "MOTOR PWR IN" and "METER OUT" terminals which are used for testing the regulator either in the shop or after installation.
3. Panel 3 has a spring return switch at the left that is normally off but can be moved up to raise the tapchange switch a tap and down to lower the tapchange switch a tap. A non-spring return switch is used to place the control in automatic operation, to turn it off, or to place it in manual operation by means of the test terminals of the second panel.
4. Panel 4 has a switch to change from automatic operation to manual operation using the second panel.
5. Panel 5 has a drag hand reset pushbutton and a neutral light.

FIG. 3 marked Prior Art is a circuit diagram of a regulator manufactured by the Cooper Power Systems Division of Cooper Industries. In this instance the series winding has eight taps used either for raising or lowering the voltage as determined by the position of the reversing switch. The number of voltage steps is doubled to 16 raise or lower by use of the bridging reactor having an equalizing winding. Note that the switch operates at the high load/source voltage.

The current transformer and control winding are insulated so as to permit the control to operate at ground potential. Note that the source, load and source/load bushings allow the regulator to operate without a local load carrying earth ground.

SUMMARY OF THE INVENTION

The inventive regulator uses a series transformer connected between source and load connections. A shunt transformer is connected between the load connection and selected taps on a secondary winding of the series transformer. Taps are selected by a tapchanger control device operating in conjunction with a hydraulic/pneumatic contact mover and control. A linear tapswitch performs the tap selection and microswitches are used by the tapchanger control device to identify each of 17 tap positions. The taps include eight 5/8% raise taps, eight 5/8% lower taps and a neutral tap giving +/−5% voltage regulation. Voltage regulation automatically changes direction when the power direction reverses. When used in a Beckwith Electric Co. Autodaptive™ system voltages are held by the system well within the +/−5% range of the inventive regulator.

No external potential or current transformers are required.

The series winding provides the power to the load required to raise the load voltage and accepts power back to the source when lowering the load voltage.

Beckwith Electric Company BLUEJAY™ Wireless equipment provides a user interface complemented by light indicators visible from a safe distance. Wireless commands can be used to set the regulator on manual operation and then to manually raise or lower the regulator tap position.

The regulator can be operated in a system using a wirelessly controlled electrically operated regulator bypass switch. This permits a lineman using a PDA or laptop computer to manually operate the regulator and to bypass the regulator from a safe remote location.

Controls can be exchanged without taking the regulator out of service.

BRIEF DESCRIPTION OF THE DRAWINGS

FIGS. 7*a* and 7*b* are two views of the sliding commutating tapswitch contact used for limiting transient current flow when changing taps.

FIG. 7*c* identifies meanings of cross hatches used on figures herein.

FIGS. 10*a* and 10*b* are two views of the series transformer.

FIGS. 11*a* and 11*b* are two views of the shunt transformer.

DESCRIPTION OF THE PRESENT INVENTION

References

1. U. S. Pat. No. 5,646,512 issued to Robert W. Beckwith, the present inventer, on Jul. 8, 1997 entitled MULTI-FUNCTION ADAPTIVE CONTROLS FOR TAPSWITCHES AND CAPACITORS which describes methods whereby tapchanger controls keep track of tap positions.
2. Continuation in part U.S. patent application Ser. No. 10/246,941 filed by Robert W. Beckwith, the present inventer, on Sep. 19, 2002 entitled WIRELESS TRANSCEIVERS USING A SIMPLIFIED PRISM II SYSTEM.
3. U.S. patent application Ser. No. 10/387,065 filed by Carl Terrior on mar. 12, 2003 entitled METHOD OF TRANSMITTING AND RECEIVING TWO-WAY SERIAL DIGITAL SIGNALS IN A WIRELESS NETWORK UTILIZING A SIMPLIFIED BASEBAND PROCESSOR.

Beckwith Electric products using above reference invention 1 have been given the trademark Autodaptive™.

Beckwith Electric products using above reference inventions 2 and 3 have been given the trademark BLUEJAY™.

Figure 1:
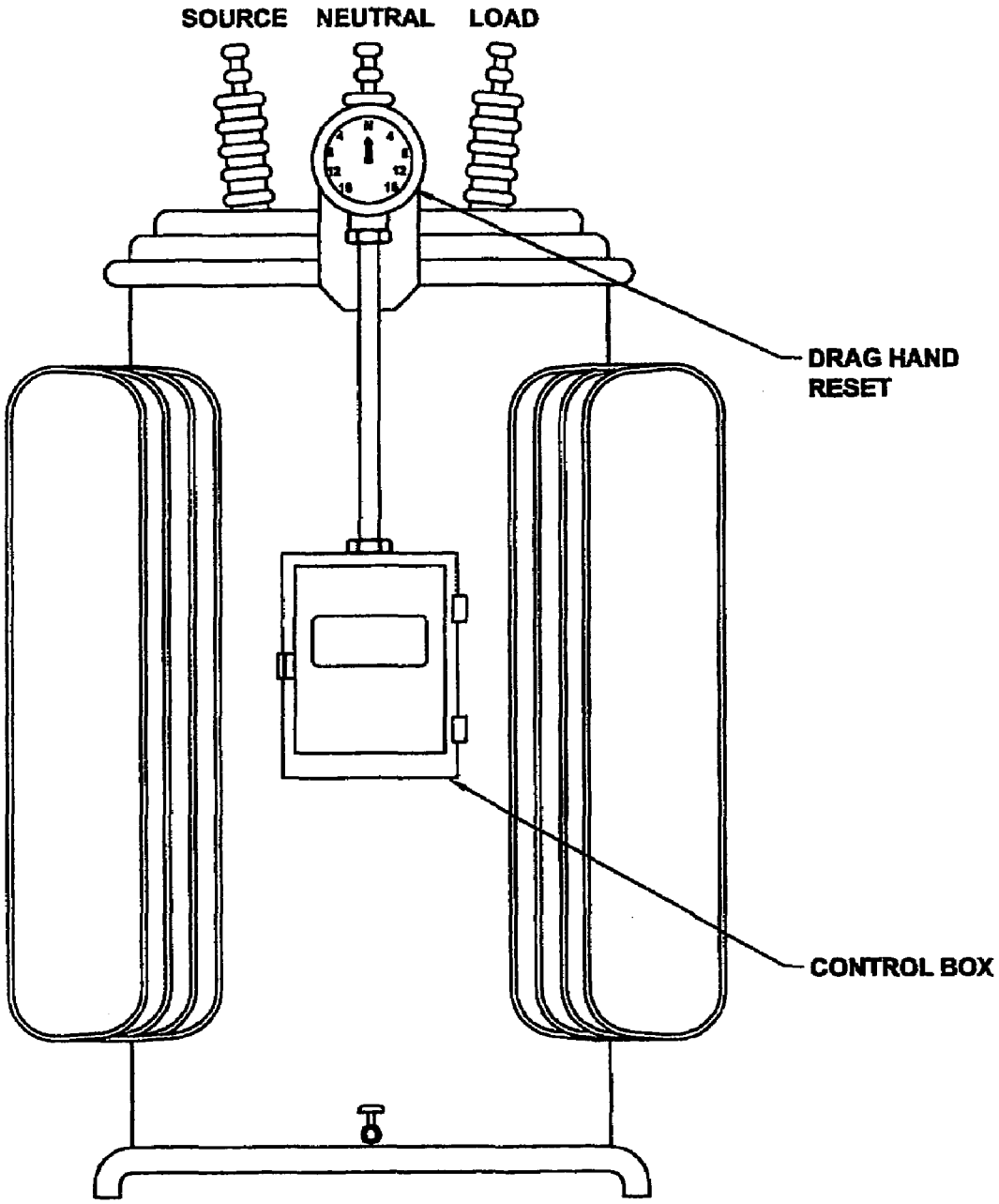
PRIOR ART Fig. 1
FIG. 1 A drawing marked prior art of a non inventive prior art General Electric VR-1™ regulator useful for comparing with the features of the present invention.
Figure 2:
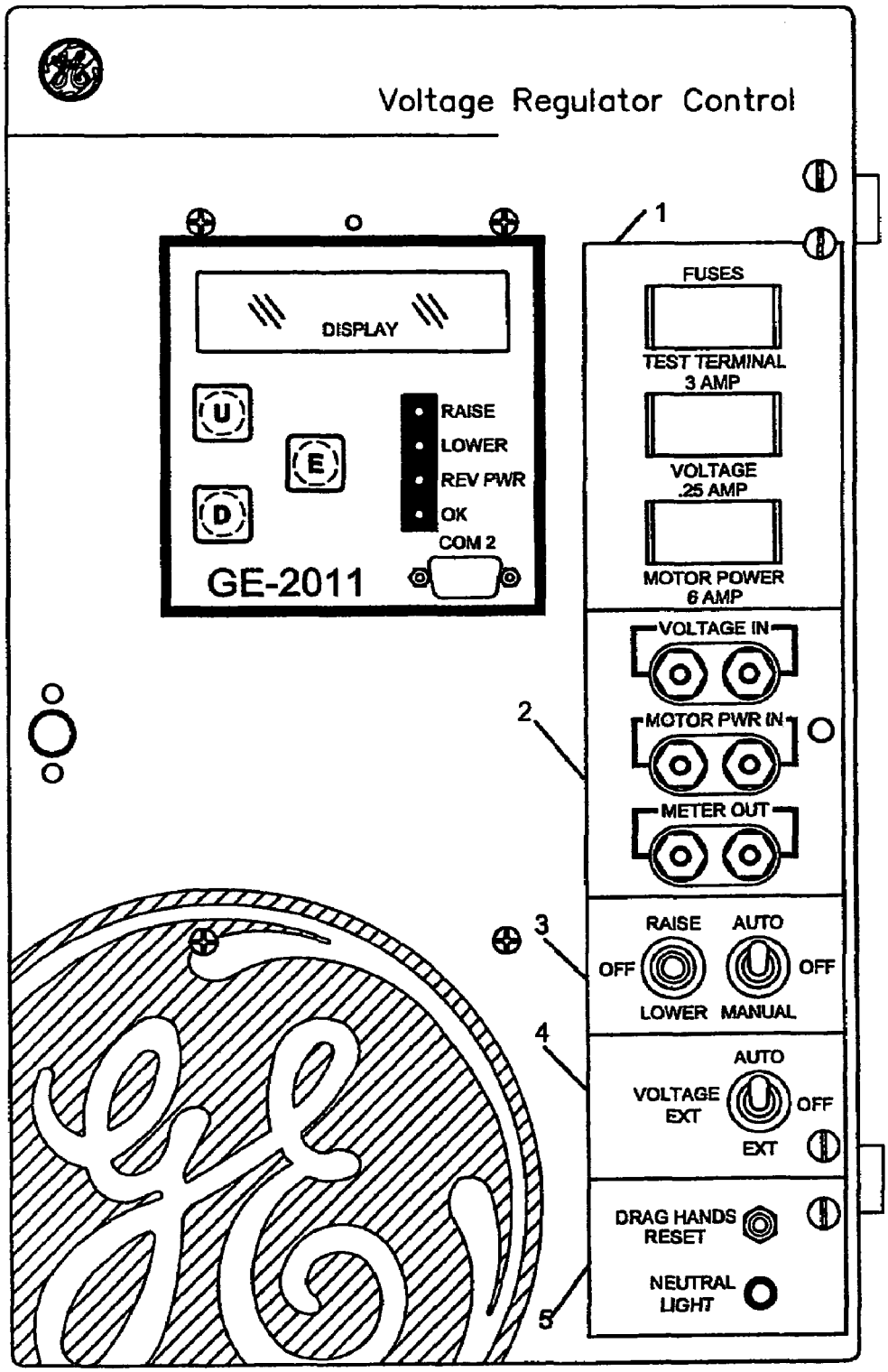
PRIOR ART Fig. 2
FIG. 2 A drawing marked prior art of the front panel of a typical non-inventive prior art regulator useful for explaining how the prior art features are accomplished using the inventive regulator.
Figure 3:
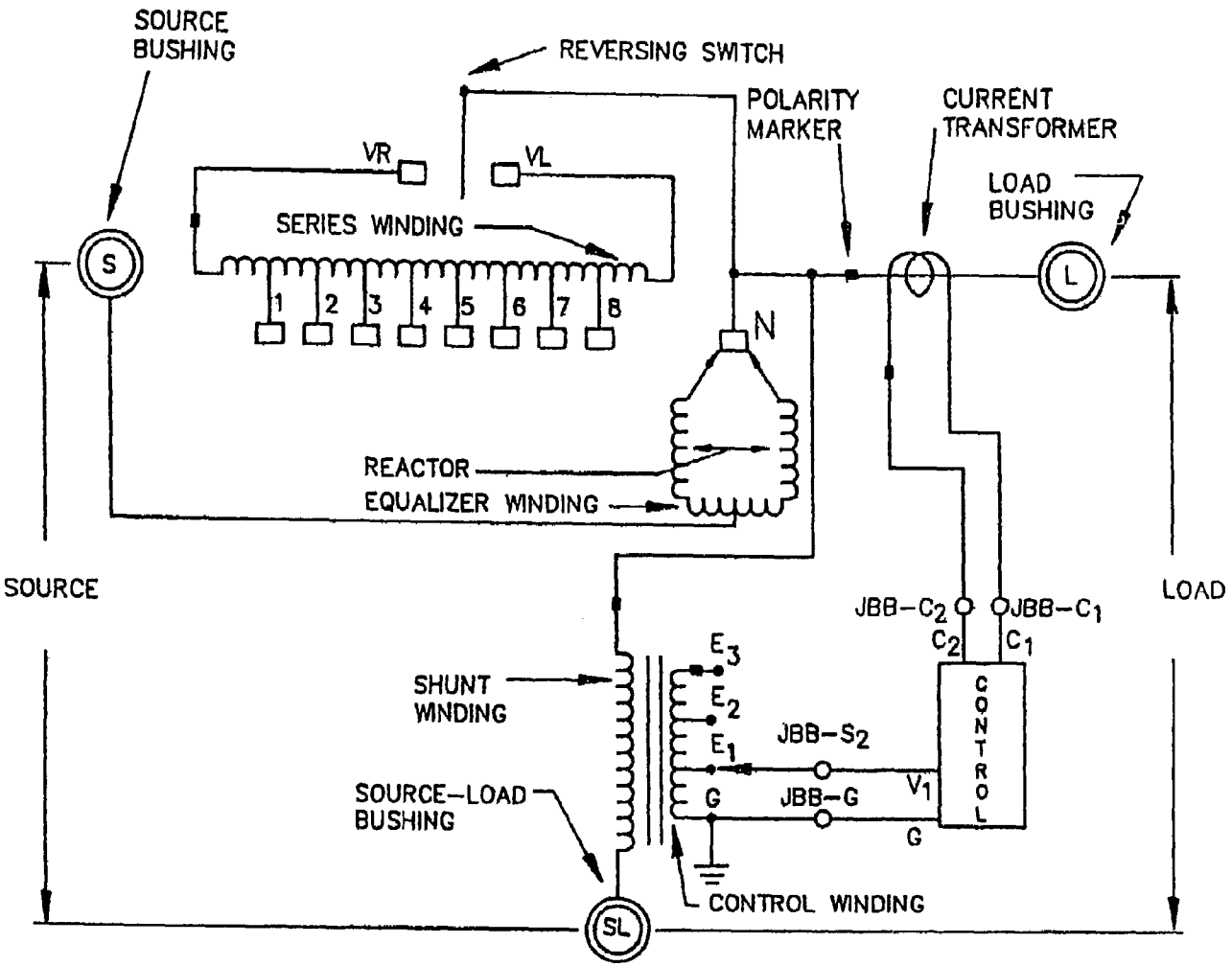
PRIOR ART Fig.3
FIG. 3 A circuit diagram, marked prior art, of a Cooper regulator useful in indicating components eliminated by the inventive regulator.

The present invention is directed to two embodiments of the invention. In comparison with FIG. 3 note that in either of the two embodiments described under FIGS. 4 and 5 below that the following components have been eliminated.

1. The reversing switch.
2. The reactor with equalizer winding.
3. A current transformer requiring load voltage insulation.
4. A source-load bushing.

Figure 4:
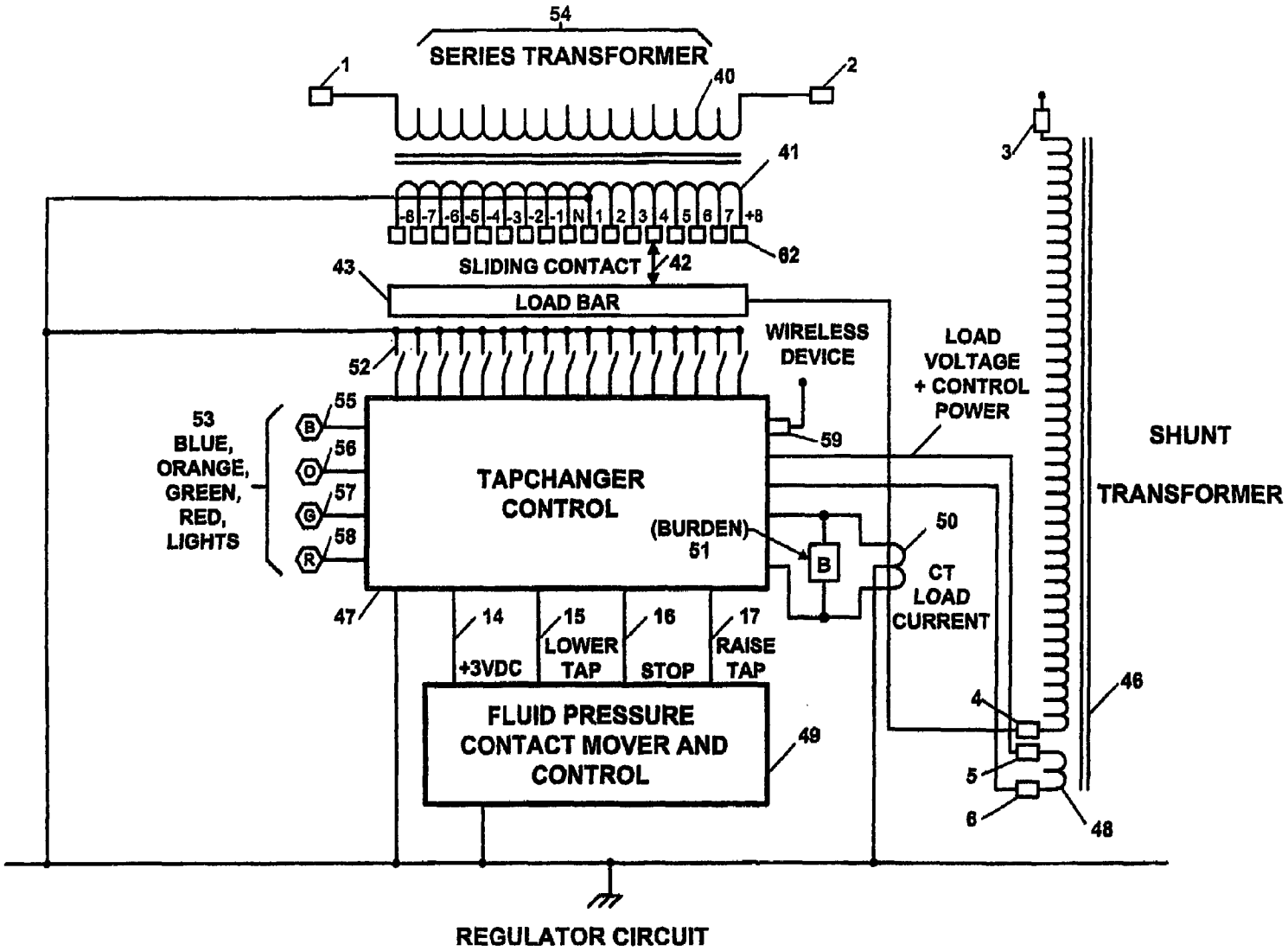
FIG. 4 A circuit drawing of a dry type inventive regulator showing a series transformer and a shunt transformer interconnected by tapswitches using a control.

FIG. 4 is a circuit diagram of the first embodiment of a dry type regulator for indoor use.

The first embodiment uses fire retardant insulation for two transformer windings so as to permit safe indoor use. These transformers have connection terminals to the source and load power lines.

The first embodiment is intended for use in high rise buildings where fire resistance greatly improves the buildings' safety. The regulators are located by an architect at one or more floors who will also use Autodaptive™ switched power factor capacitor banks on each floor. The Autodaptive™ thereby provides automatic +/−1% voltage control at all times of the day throughout the building. This is expected to improve the efficiency in the use of electric power in the building by approximately 5%. Note that the present invention is limited to the improvements obtained by use of the first embodiment regulator.

The inventive regulator uses series transformers 54 with primary windings 40 connection terminals 1 for connection to the source of electric power and primary windings 40 connection terminals 2 for connection to the load for electric power thereby sensing the differential in voltage across the regulator. This voltage varies between +5% rise from source to load to −5% drop from source to load. One half way between these two extremes the voltage drop is zero with no change in voltage from the regulator.

The secondary winding 41 of transformer 54 has 17 taps corresponding to +/−5% change from 16 taps with a neutral tap in the center making the total of 17 secondary winding 41 taps. The neutral tap (N) is connected to ground. A sliding contact 42 connects selected ones of the 17 taps to be connected to a load bar 43.

Shunt transformers 46 have connection terminals 3 for connection to said load for electric power and connection terminals 4 connected to load bar 43. A winding 48, having connection terminals 5 and 6, on transformers 46 carry a voltage, selectively of 3 Vac, to tapchanger control devices 47. Tapchanger control devices 47 use this voltage in a measurement of load voltage between load connection bushings 45 and ground. It also uses this voltage to develop a voltage, selectively +3 Vdc, for operating tapchanger control devices 47 and fluid pressure contact mover and control devices 49.

A current transformer 50 with burden 51 measures the regulator load current and is connected to tapchanger control devices 47 for use in computing the regulator load in Watts and VArs. Three wire connections are made to load current CTs 50, two connections to tapchanger control devices 47 and CTs 50 center taps to ground. CTs 50 and its burden 51 are designed to produce a full cycle of load current analog voltage input to tapchanger control devices 47 to convenience the scaling to the digital form of the current. The CTs 50 center taps permit tapchanger control devices 47 to sense both half cycles of the current wave to properly measure distorted load currents. Burdens 51 are designed to suppress voltage transient damage resulting from abnormal currents caused by power line faults on the regulator load. In this way damage to tapchanger control devices 47 circuity from line faults is prevented.

Sliding contacts 42 operates one of 17 microswitches collectively marked 52. These microswitches 52 have one common terminal connected to ground and the other 17 non-common terminals connected to tapchanger control devices 47. Pull-up resistors within tapchanger control devices 47 place +3 Vdc on the 16 microswitches 52 not closed by the position of sliding contact 42. The microswitch 52 closed by the position of sliding contact 42 reduces the +3 Vdc to zero thereby providing tapchanger control devices 47 an indication of which one of the 17 tap positions is selected by sliding contact 42 at any point in time.

Taps on windings 41 are marked from +1 through +8 representing 5/8% increase per tap in voltage through the regulator from source to load as selected by the sliding contact 42. Taps on windings 41 are marked from −1 through −8 representing ⅝% decrease per tap in voltage through the regulator from source bushing 44 to load bushing 45 as selected by the sliding contact 42. Each winding 41 tap marked (+) selected by sliding contact 42 will raise the load bar 43 above ground adding to the load voltage existing on load bushing 45 connection terminal to ground. Each winding 41 tap marked (−) selected by sliding contact 42 will lower the load bar 43 below ground subtracting from the load voltage existing on load bushing 45 connection terminals to ground.

The tapchanger control devices 47 compute the load voltage to ground by combining the voltage obtained from transformers 46 winding 48 terminals 5 and 6 with the voltage added or subtracted from load bar 43 as indicated by the closed microswitch 52 indicating the winding 41 tap position.

The connections from microswitches 52 are also used to provide the following light outputs from four arrays 53 of LEDs visible at a safe distance from the tapchanger control devices 47:

1. Sensing voltages from windings 48 of shunt transformers 46 a self-diagnostic program in the tapchanger control devices 47 lights arrays 57 of green LEDs indicating "power is on and control operation is OK".

2. Sensing the microswitch 52 "N" closures to circuit ground an array 58 of red LEDs are lighted indicated the sliding contact 42 is on the neutral (N) tap position.

3. Sensing microswitch 52 closures to circuit ground of any tap position +1 through +8 an array 55 of blue LEDs are lighted indicated the sliding contact 42 position is raising the regulator voltage to the load. A flashing blue array 55 indicates the sliding contact 42 is +8 and the load voltage is still too low.

4. Sensing microswitch 52 closures to circuit ground of any tap position −1 through −8 an array 56 of orange LEDs are lighted indicated the tapswitch is lowering the regulator voltage to the load. A flashing orange array 56 indicates the tap position is −8 and the load voltage is still too high.

Figure 5:
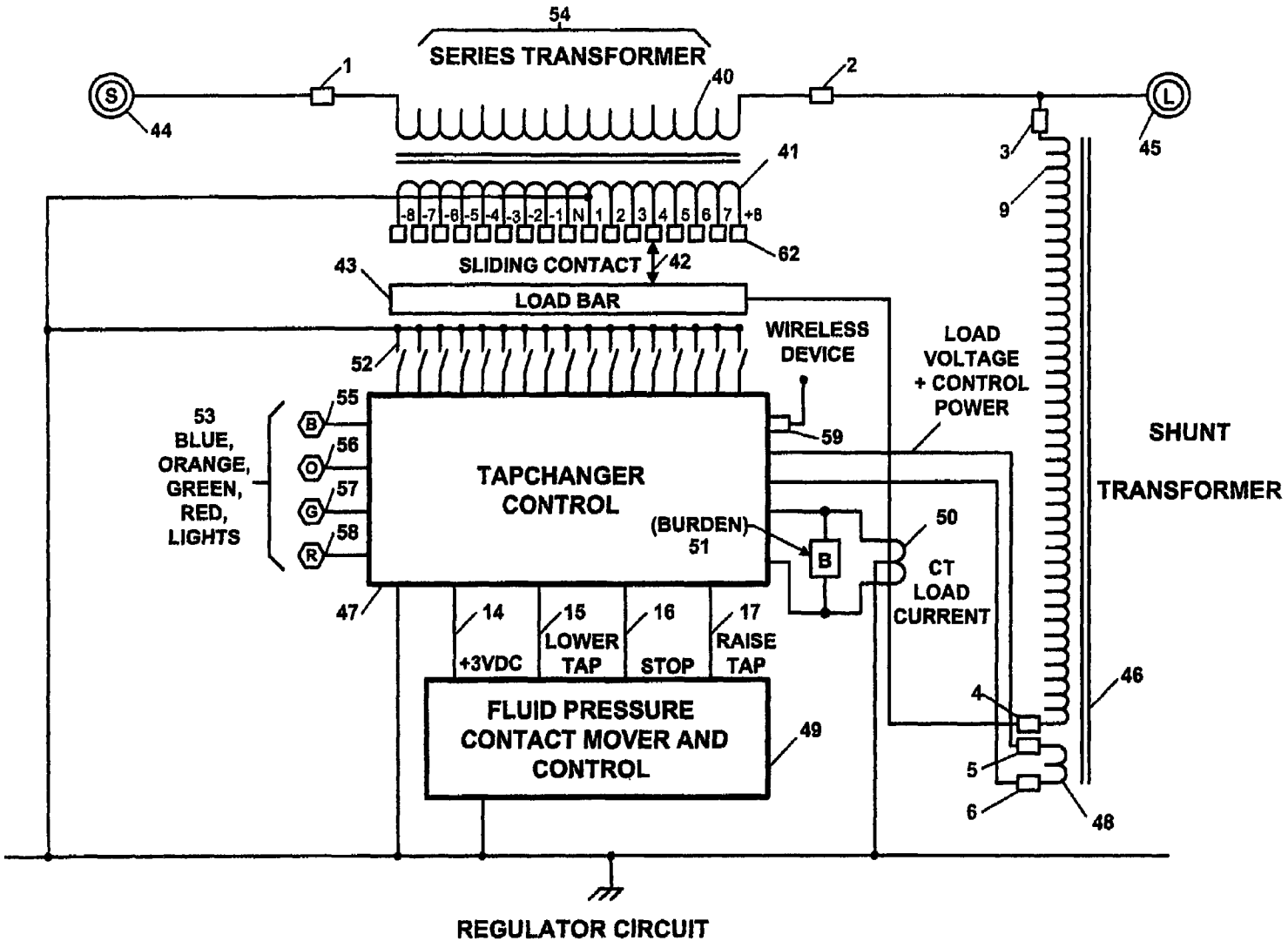
FIG. 5 A circuit drawing of an oil filled inventive regulator showing a series transformer and a shunt transformer interconnected by tapswitches using a control.

FIG. 5 is a circuit diagram of the second embodiment of the inventive regulating apparatus (regulator). The second embodiment uses an oil filled tank and power connection bushings together capable of use outdoors under nearly all weather conditions. The transformer connection terminals are connected to the bushings required for outdoor use.

This diagram is identical with that described above under FIG. 4 with the addition of connections from series transformer 54 primary connection 1 to source bushing 44, connections from series transformer 54 primary connection 2 to load bushings 45 and connections from shunt transformers 46 connection 3 to load bushings 45.

The second embodiment is intended to fulfill the requirements of a portion of the of the worldwide market for regulators as defined by the following boundaries:

a. For use in 13 kV distribution substations or along 13 kV distribution lines.

b. Sized at 166.6 kVAr each for use in 500 kVAr sets of three for substation use or on three phase distribution lines. Also for use on single phase distribution lines.

Note that regulators are used from line to ground making the nominal voltage of the inventive regulator from source or load to ground 8400 Volts ac.

c. For use at 60 Hz.

d. For use wherever the neutral conductor is grounded if a neutral wire is carried along with the three phase wires. Also for use where this is not the case and the earth ground is used as the ground return path for currents which result from unbalanced loads on the three phases.

Note also that wherever a regulator ground and/or a user electrical load ground have an indeterminate voltage difference from true earth ground that the quality of the effective voltage regulation from regulator to user may be compromised.

The invention has three major objectives as compared to prior art regulators:

1. Reduce the time and cost required either to replace an installed regulator or to replace only the tapchanger control device.

2. Reduce the manufacturing cost.

3. Provide Autodaptive™ performance. The inventive regulator is most effectively used with the Beckwith Electric Autodaptive control system as described in reference 1 U.S. Pat. No. 5,646,512. This patent describes the use of especially programmed load tapchanging transformer or regulator controls together with especially programmed controls to switch capacitor banks placed along distribution lines to provide superior (+/−1% typical) voltage regulation along a distribution line. This superior line regulation justifies the use of +/−5% voltage regulation by the inventive regulator as compared to +/−10% for most prior art regulators.

FIG. 5 further shows fluid pressure contact mover and control devices 49. This control receives a lower command from tapchanger control devices 47 on control interconnections 15, a raise command on control interconnections 17 and a stop command on control interconnections 16. The stop command is generated in response to closure of the microswitches 52 contact to which the sliding contact has been directed by a raise or a lower command. The stop command on control interconnection 16 assures that the sliding contact will not move until the next raise or lower command is received on control interconnection 15 or 17. Control power of +3 Vdc is brought from tapchanger control devices 47 to contact mover and control devices 49 on control interconnections 14.

The flow of power through the inventive regulator is as follows:

When the sliding contact 42 is on any position +1 through +8, the tapchanger control devices 47 are calling for a raise in voltage through the regulator and the proper amount of power is sent from the series transformer 54 to the shunt transformers 46 where it is received and sent to the load thereby increasing the load voltage to a desired level. When the sliding contact 42 is on any position −1 through −8, the tapchanger control devices 47 are calling for a lowering in voltage through the regulator and the proper amount of power is sent from the load, through the shunt transformers 46, through the series transformers 54 where it is received and sent back to the source thereby decreasing the load voltage to a desired level.

When the sliding contact 42 is on the "N" microswitch 52 tap position there is no voltage from the source to the load therefore there is no power flow through the regulator.

Figure 6:
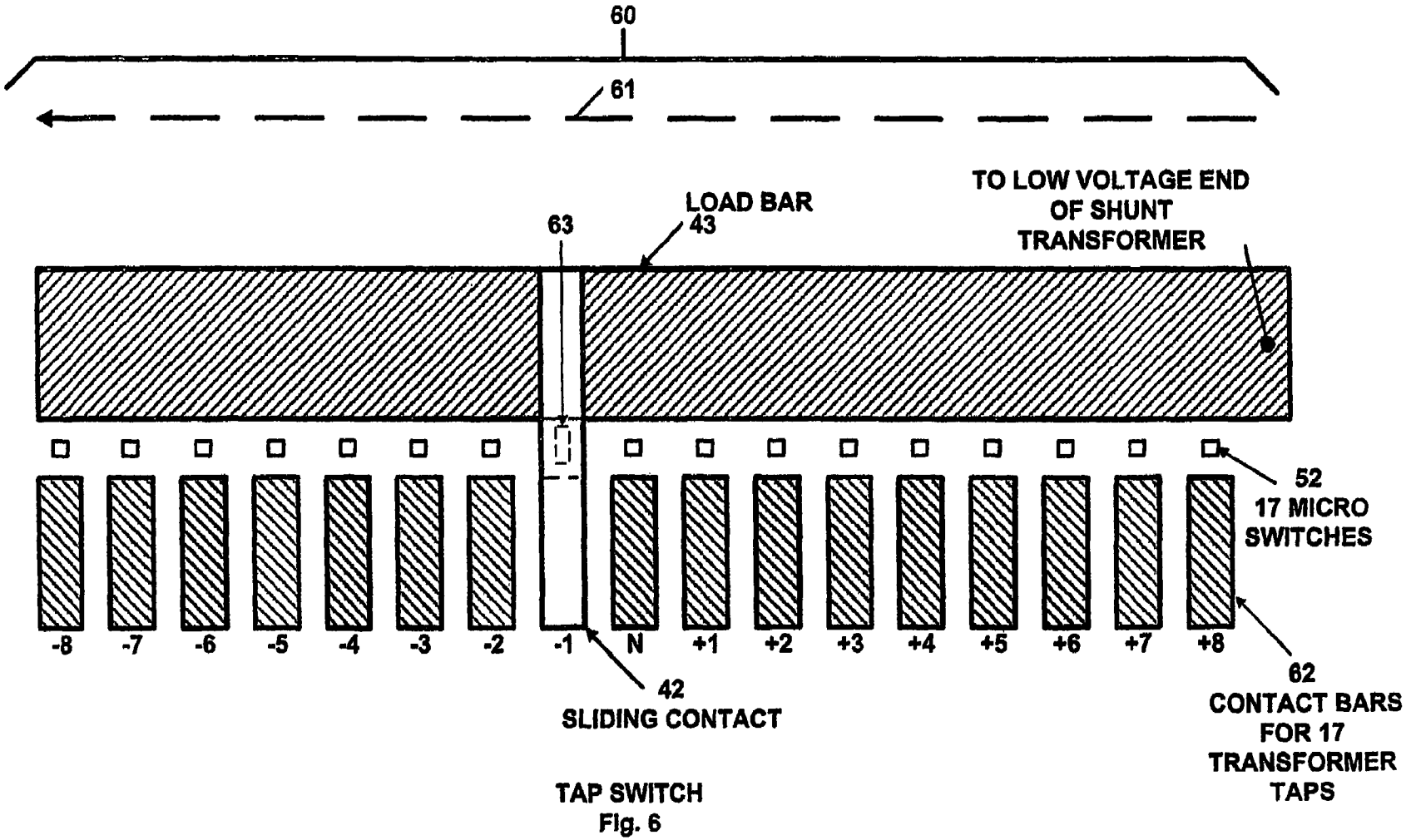
FIG. 6 A top view of the 17 step linear tapswitch operated by fluid pressure.

FIG. 6 shows a top view of linear tapswitches 60. This switch is built on a printed circuit board 61 selectively ½ inch thick. Tapswitches 60 have 17 contact bars collectively marked 62 on which a first end of sliding contacts 42 move. These contact bars 62 are connected to 17 series transformer 54 secondary 41 taps as shown in FIGS. 4 and 5. The second end of sliding contacts 42 rides along load bars 43. Projections 63 on the underside of sliding contacts 42 close one of 17 microswitches, collectively marked 52, connected to tapchanger control devices 47 as shown on FIG. 4. A continuous sliding electrical contact is made from load bars 43 to contact bars 62.

The sliding contact 42 is moved selectively using pressures within the oil which fills an embodiment 2 regulator. Whichever microswitch 52 closes as a result of the move is used to stop the sliding contact 42 when centered on a tap position. In dry type embodiment 1 regulators air pressures are used to move sliding contact 42.

FIGS. 7*a* and 7*b* show two views of the first end of sliding contacts 42. FIG. 7*a* is with sliding contact 42 crossing from one contact bar 62 to a second contact bar 62. FIG. 7*b* is with sliding contacts 42 at rest at the center of one contact bar 62. Fluid pressure holds the copper portion 65 of the contact up (an exaggerated distance for clarity) so as not to make contact with contact bars 62. Slabs 66 of current limiting material carry current during the brief time the bars are shorted together as current moves from sliding contact 42 to one bar 62 and then to the next bar 62. The current limiting material 66 has a very high positive coefficient of resistance which resistance therefore goes very high during a brief short circuit condition across two bars 62.

FIG. 7*c* indicates the background shading used to indicate material, copper, fluid or current limiting material as used herein.

Figure 8:
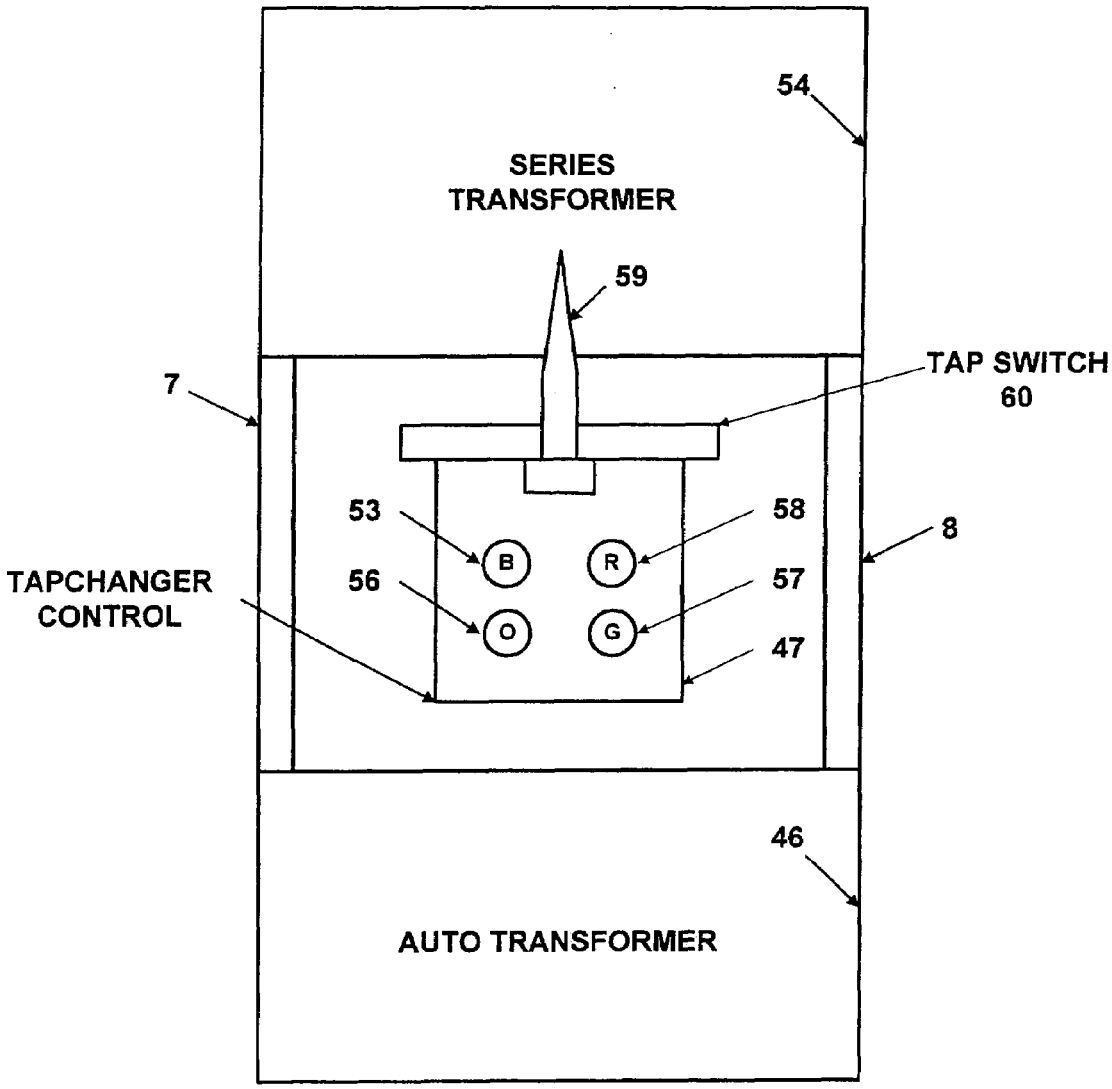
FIG. 8 An outline drawing of a dry embodiment of the inventive regulator.

FIG. 8 shows a view of the first embodiment of dry type regulators for indoor mounting. Shunt transformers 46 are on the bottom, tapchanger control devices 47 are shown midway up the assembly with LED lights 55, 56, 57 and 58 showing forward. Wireless antennae 59 are shown protruding upward out of the front of tapchanger control devices 47. Tapswitches 60 are shown above tapchanger control devices 47. Series transformers 54 are shown at the top of the assembly, supported by brackets 7 and 8.

Figure 9:
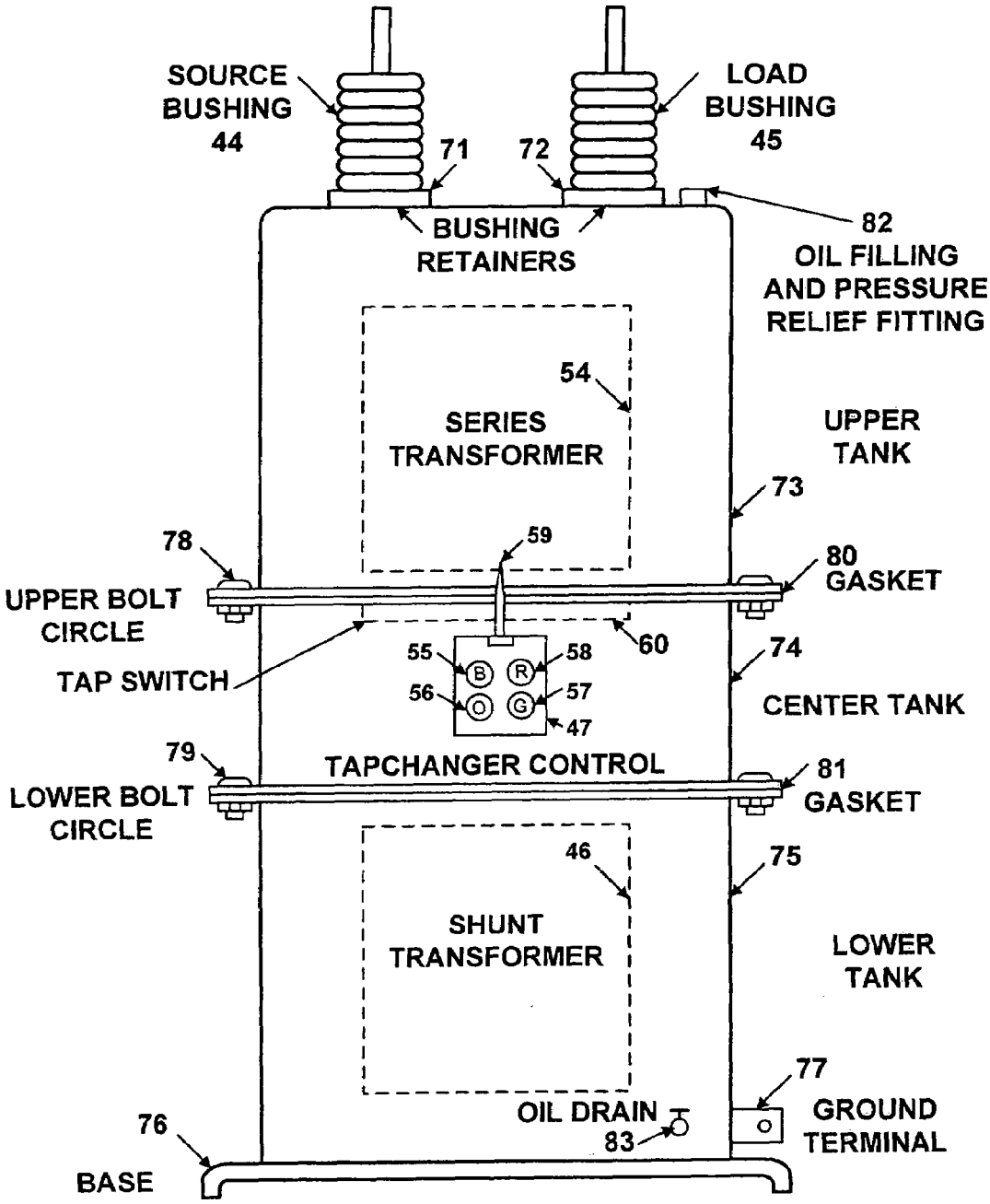
FIG. 9 An outline drawing of an oil filled embodiment of the inventive regulator.

FIG. 9 shows an outline view of the second embodiment of oil filled regulators for outdoor use. The regulator tank consists of three cylindrical parts, an upper tank 73, a center tank 74 and a lower tank 75. The lower tank 75 is fastened to base 76 and has an oil drain 83 and ground terminal 77 located as shown by FIG. 9. The upper tank 73 has an oil filling and over-pressure relief fitting 82 mounted on the upper tank top surface. The three tank components are held together by two tank rings. An upper tank ring between the upper and center tanks is held together by bolt ring 78 using gasket 80 to seal the tank from oil leaks. A lower tank ring between the center and lower tanks is held together by bolt ring 79 using gasket 81 to seal the tank from oil leaks.

Tapchanger control devices 47 are seen mounted on the outside surface of center tanks 74. On the controls are seen lights 55, 56, 57, 58 and wireless communications antennae 59. These items were described in greater detail under FIG. 4 above.

The bushings 44 and 45, the series transformer 54, the tapswitch 60, and the shunt transformer 46 are fastened together mechanically and have lifting eyes not shown for removing the entire structure from the center 74 and lower 75 tanks. The upper tank can be lifted off by opening the upper bolt circle 78 and the bushing retainers 71 and 72. With upper tank 73 and tapchanger control devices 47 removed the oil tight socket for tapchanger control devices 47 may be removed and the entire structure lifted out of the lower two tank sections.

Tapswitches 60 are then in open view. The sliding contact 42 can be removed and the current limiting slabs 66 replaced. Other repairs can be made if found necessary.

FIGS. 10*a* and 10*b* are two views of the series transformer 54 with the transformer primary windings 40 and secondary windings 41 encased in a molded fire retardant material. This provides the necessary winding insulation for dry type indoor use and improves the control of voltage gradients when used in an oil filled regulator.

FIGS. 11*a* and 11*b* are two views of the shunt transformer 46. The transformer 46 primary windings 9 and secondary windings 48 are encased in a molded fire retardant material. This provides the necessary winding insulation for dry type regulators for indoor use and improves the control of voltage gradients when used in oil filled regulators.

Figures 12A, 12B, 12C:
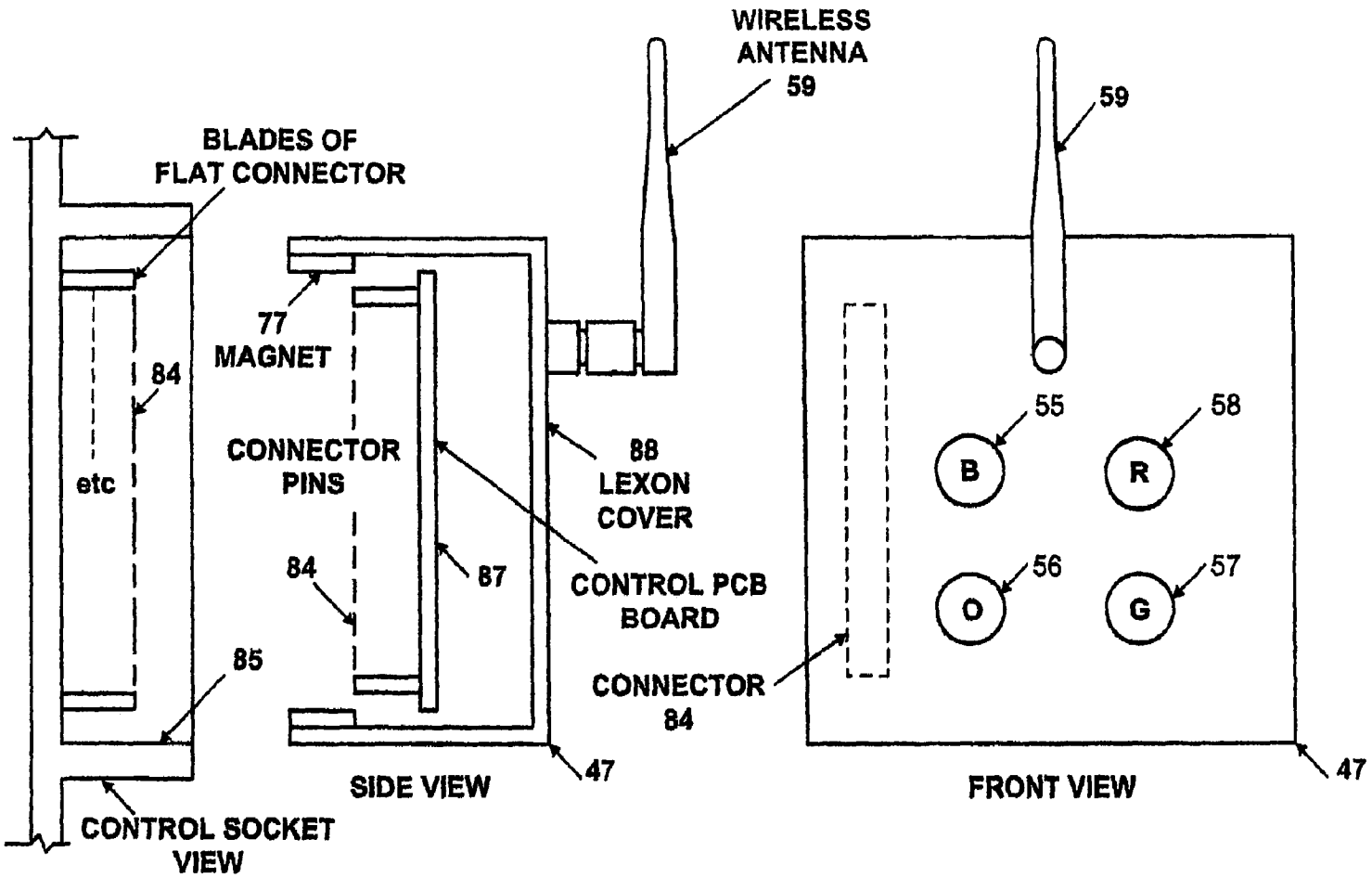
FIGS. 12*a*, 12*b* and 12*c* are views of the tapchanger control device socket and box illustrating methods of inserting and removing the control.

FIGS. 12*a*, 12*b*, and 12*c* illustrate tapchanger control devices 47 and shows the control sockets 85. The tapchanger control device 47 can be removed from sockets 85 with the tapswitch staying on the last position before control removal. Load voltage regulation will, of course, cease.

Tapchanger control devices 47 use control printed circuit (PC) boards 87 which are connected by flat blade connectors 84 to control sockets 85. Flat blade connectors 84 are shown in the socket view, the side view and the front view of FIG. 12. Transparent lexon covers 88 are used to give strength to tapchanger control devices 47 box as well as to make the LED displays visible as described under FIG. 4. Magnets 77 hold the tapchanger control devices 47 in place yet removable without problems of metal latches rusting tight or mounting parts falling to the ground. Wireless antennae 59 provides communication into prior art Beckwith Electric Company BLUEJAY™ networks.

The tapchanger control devices 47 performs several functions:

1. Controls the load voltage using the prior art Beckwith Electric Autodaptive™ method of control. This method of control is described in reference 1 U.S. Pat. No. 5,646,512 issued to Robert W. Beckwith, the present inventer.
2. The mechanical tap position indicator, drag hand and drag hand reset are eliminated in the inventive regulator and replaced by software contained in tapchanger control devices 47. This software also permits operating the regulator in a manual mode for installation and maintenance testing. A Beckwith Electric Company user interface programs known as Taptalk™ is available for communicating with tapchanger control devices 47 by means of PDAs, laptop or fixed location PCs. Such user interface computers can be used to read and display history files stored on the control printed circuit boards 87. The data includes tap switch operation, direction of power flow through the regulator, power factor and current magnitude. Making use of prior art tapchanger control programs this data may selectively have a time resolution of six minutes and file length of up to six months.

Power reversal through the regulator is recognized by the controls. Prior art regulators following reference 1 U.S. Pat. No. 5,646,512 issued to Robert W. Beckwith, the present inventor, use a keep track method to determine regulator tap position. Existing prior art programs determine the real and imaginary components of power flow through a regulator with the change of sign of the real power flow used as the indication of power reversal.

Tapchanger control devices 47 continuously compute the real and imaginary components of power flow using load voltage from windings 48 of transformers 46 corrected for increase or decrease in voltage by currents from load bars 43 together with full wave current from center tapped CTs 50 all as shown on FIG. 4. A change is sign of the real component of power is taken as a reversal in direction of power flow. Tapchanger control devices 47 then automatically provide voltage regulation of amounts of power flowing in the source direction. The tapchanger control device 47 makes the necessary reverse power direction computations using the positive tap position knowledge provided by microswitches 52. Inventive tapchanger control device 47 programs make use of prior art tap position keep track programs which are modified using the inputs from microswitches 52 as positive indication of tap position.

In a substation application using the inventive regulator on three phases of several outgoing three phase lines, the communicating computer may be in a fixed location eliminating hard wiring within the substation.

Figure 13:
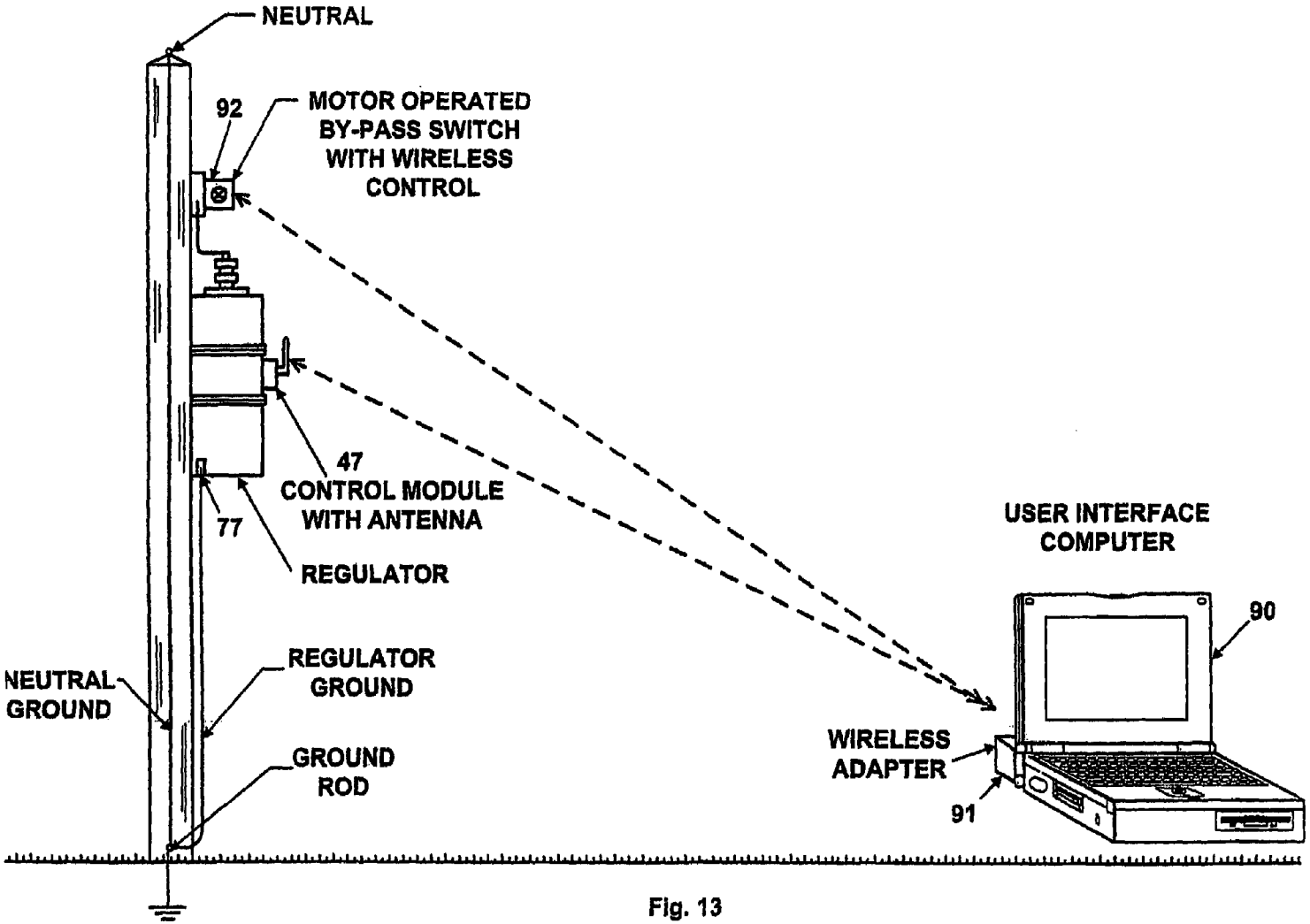
FIG. 13 An integrated system consisting of the inventive regulator, an electrically operated bypass switch and a user interface computer with wireless communications between members of the system.

FIG. 13 illustrates a system consisting of a user interface computer 90 with wireless adapter 91. The user interface computer 90 can be used for wireless communications with the tapchanger control devices 47 for entering of setpoints and for reading of stored history information covering past operation of the inventive regulator. Maximum and minimum tap positions since a reset together with a reset command (Drag hand and drag hand reset) are provided by wireless connection to user interface computers 90.

The user interface computer can be used for determining that the regulator is on the neutral position and then for operating wirelessly controlled electrically operated regulator by pass switches 92. For maximum safety in this operation the following can be done to protect the system for misuse either from operator error or by unauthorized persons:

1. Use of encrypted communications.
2. Providing the operator a digital memory key that must be plugged into the user interface computer before a by pass switch close command can be sent.

FIG. 13 also shows the regulator ground 77 and the neutral ground connected together at the base of the pole on which the regulator is mounted along with connection to a ground rod.

FIG. 13 shows a pole with the regulator mounted on the pole. A neutral conductor is shown on the top of the pole with a conductor going down the pole to ground. This neutral conductor with connection to earth ground may not always be present.

As shown by FIG. 13, the inventive regulator can selectively include wireless communications within a system consisting of the regulators, tapchanger control devices 47 with wireless communications, motor operated regulator bypass switches with wireless controls and a choice of user interface computers having a wireless adaptor.

Since a motor operated bypass switch is not presently available a motor operated actuator with wireless control is provided to operate existing mechanical switches. These switches are known to safely bypass the regulator and open circuits from the regulator without interrupting power flow. Security can be provided against unauthorized operation by use of a key operated switch in the motor power source which is only closed when the wireless operation is about to be made using the user interface computer at a safe distance from the regulator.

Preferably communications is via prior art Beckwith Electric BLUEJAY™ communication techniques. These products operate as described in references 2 and 3, cited above.

The motor operated regulator bypass switch can be added as an option to give the lineman greater security by allowing operation from a safe distance. A high speed fuse can be used in the bypass circuit which may prevent the regulator from exploding should the regulator not be on neutral.

Whether or not the motor operated by pass is used, a user interface program is used in a battery operated lap-top computer or in a PDA. This can be used to enter and change setpoints in tapchanger control devices 47 or to obtain data. Tapchanger control devices 47 have sufficient memory to hold four weeks of operating information with a time resolution of six minutes. The user interface computers use passwords to avoid unauthorized operation of the regulator or the bypass switch.

The preferred form of the inventive regulator shown in FIG. 5 is for a nominal 8400 Vac load voltage, 166.66 kVA power rating (three regulators in a three phase configuration then provide a 500 kVA bank) and +/−5% voltage regulation with automatic control of the source voltage upon power flow reversal. In addition the preferred tapchanger control devices 47 are programmed using technology from reference 1 US Patent to operate with switched capacitor banks to produce superior flat voltage regulation from the regulator to the furthest capacitor bank fed by the regulator. Systems using this combination of transformer and regulator controls and capacitor switching controls have been given the registered trade name "Autodaptive$^{SM}$" by the Beckwith Electric Company. The inventive regulator will therefore become known as an "Autodaptive™ Regulator"

One use of the preferred form of the regulator is to regulate voltages midway along three phase 13 kV power distribution lines feeding electric power to homes and businesses from electric distribution substations. Some electric power companies may also use the inventive regulator on each phase of three phase lines leaving electric power distribution substations.

The present inventive regulator can be modified for regulators meeting the requirements of other portions of the world market where different voltages and frequencies are used.

Advantages of the Inventive Regulator

1. Reduce the manufacturing cost.
2. Provide Autodaptive™ performance when used with switched capacitor banks.
3. Ease of field replacement of the automatic control without interruption of power.
4. Ease of field replacement of an entire regulator.
5. Light weight.
6. Use of wireless communications eliminates the need to mount controls at ground level or use bucket trucks to service properly operating regulators mounted at line height on pole structures.
7. Regulator may be set to neutral and bypassed from a safe distance using wireless communications from a user interface computer.

I claim:

1. Single phase under load tapchanging voltage regulating apparatus said apparatus comprising in combination:

a) source connection bushing means for connection to sources of electric power, said electric power being capable of flowing in a forward or reverse direction,
b) load connection bushing means for connection to loads for electric power, said electric power being capable of flowing in a forward or reverse direction,
c) series transformer means for exchanging electric power arising from voltage differences between said source connection bushings and said load connection bushings,
d) shunt transformer means for exchanging electric power with loads for electric power,
e) connection means for connecting first ends of said series transformer primary windings to said source connection bushings,
g) connection means for connecting second ends of said series transformer primary winding to said load connection bushings,
h) connection means for connecting first ends of said shunt transformers windings to said load connection bushings,
i) series transformer secondary winding means with taps for selecting amounts of power for flowing in either direction through said series transformers,
j) switching device means for selecting said taps so as to cause varying amounts of electric power to flow in either direction through said series transformers,
k) connection means between said switching device and second ends of said shunt transformer windings for directing said varying levels of electric power to flow from said series transformers in either direction to said shunt transformers and thus to said loads for electric power, and
l) tapchanger control device means for sensing the voltage at said load connection bushings and causing said switching devices to select the proper electric power to flow in either direction so as to maintain desired voltages at said load connection bushings.

2. Apparatus as in claim 1 further comprising in combination:

a) contact bar means for connecting said switching devices to said series transformer secondary winding taps,
b) load bar means for connecting said switching devices to said second ends of said shunt transformer windings,
c) sliding contact means for connecting from said load bars to said contact bars,
d) fluid pressure contact mover and control device means for moving said sliding contacts from one said contact bar to another contact bar,
e) tapchanger control device command interchange means for giving commands to said fluid pressure contact mover and control devices,
f) first said tapchanger control device command interchange means for causing said hydraulic contact mover and control to raise said series transformer secondary winding tap position by one tap increment,
g) second said tapchanger control device command interchange means for causing said hydraulic contact mover and control to lower said series transformer secondary winding tap position by one tap increment, and
h) third tapchanger control device command interchange means for causing said hydraulic contact mover and control to stop making changes in said series transformers secondary winding tap positions.

3. Apparatus as in claim 1 further comprising in combination:

a) microswitch means for said switching device for indicating the identity of said series transformers secondary winding tap positions,
b) connection means between said microswitches and said tapchanger control devices for enabling said tapchanger control devices to take action dependent on identity of tap positions,
c) arrays of blue light means for indicating a rising of voltage, and
d) tapchanger control device means for sensing tap positions indicating a voltage rise through regulators and lighting said arrays of blue lights.

4. Apparatus as in claim 3 further comprising in combination:

a) tapchanger control device means for sensing tap position +8 indicating a maximum voltage rise through regulators,
b) tapchanger control device means for recognizing further voltage rise is required, and
c) tapchanger control device means for causing said arrays of blue lights to flash thus indicating an inability of the regulator to provide the power required to maintain the load voltage.

5. Apparatus as in claim 1 further comprising in combination:

a) microswitch means for said switching device for indicating the identity of said series transformer secondary winding tap positions,
b) connection means between said microswitches and said tapchanger control devices for enabling said tapchanger control devices to take action dependent on identity of tap positions,
c) arrays of orange light means for indicating a drop in voltage through regulators, and d) tapchanger control device means for sensing tap positions indicating voltage drops through regulators and lighting arrays of orange lights.

6. Apparatus as in claim 5 further comprising in combination:

a) tapchanger control device means for sensing tap position −8 indicating maximum voltage drops through regulators, b) tapchanger control device means for recognizing further voltage lowering is required, and c) tapchanger control device means for causing said arrays of orange lights to flash thereby indicating an inability for the regulator to pass sufficient power back to the source of electric power to hold the voltage down to desired levels.

7. Apparatus as in claim 1 further comprising in combination:

a) arrays of green light means for indicating normal operation, and b) tapchanger control device self diagnosis program means for lighting said arrays of green lights indicating no maintenance of the regulator and its tapchanger control is required.

8. Apparatus as in claim 1 further comprising in combination:

a) microswitch means for said switching device for indicating the identity of said series transformer secondary winding tap positions, b) connection means between said microswitches and said tapchanger control devices for enabling said tapchanger control devices to take action dependent on identity of tap positions, c) shunt transformers secondary winding means for sensing voltages across said shunt transformers, d) connection means for said tapchanger control devices sensing said shunt transformers secondary windings, and e) program means for said tapchanger control devices for converting said voltages across shunt transformers to regulator load voltages dependent on identity of tap positions.

9. Apparatus as in claim 8 further comprising in combination:

a) current transformer means for measuring regulator load current, b) burden means for carrying current transformer output currents so as to develop voltages proportional to regulator load currents, c) connection means for said tapchanger control devices sensing said voltages proportional to regulator load currents, and d) tapchanger control device program means for combining regulator output voltage information and regulator load current information so as to determine the regulator power load and its direction of flow through the regulator, e) further tapchanger control device program means for computing regulator source voltages when power flow through regulators is reversed, and f) further tapchanger control device program means for causing said switching devices to select proper electric power flows so as to maintain desired regulator output voltages in either direction of power flow.

10. Apparatus as in claim 9 further comprising flashing said arrays of green lights whenever power is determined to be flowing in the reverse direction through said regulator.

11. Apparatus as in claim 3 further comprising in combination:

a) tapchanger control device means for sensing the neutral "N" positions of said series transformers secondary winding taps, b) arrays of red light means for indicating the regulator being on the "N" tap position, and b) tapchanger control device means for causing said array of red lights to light thus indicating that the regulator in on the neutral tap.

12. Apparatus as in claim 1 further comprising in combination:

a) tapchanging control device socket means for holding said tapchanger control device on the outside of said regulating apparatus, and b) socket connection means for connecting voltages and signals as required by said tapchanging control device.

13. Apparatus as in claim 12 further including magnetic means for holding said tapchanging control device in said socket.

14. Apparatus as in claim 1 further comprising in combination, a) interface computer means for human communications with said tapchanging control devices, b) wireless communications means for communicating with said tapchanging control device, and c) compatible wireless communications means for communicating with said interface computer whereby an operator can operate the regulator from a remote location.

15. Apparatus as in claim 1 further comprising in combination, a) interface computer means for human communications with said tapchanging control devices, b) wireless communications means for communicating with said tapchanging control devices, c) compatible wireless communications means for communicating with said interface computers.

d) motor operated bypass switch means for bypassing said voltage regulating apparatus, e) compatible wireless communications means for communicating with said bypass switch from said interface computer, f) program means for said interface computer communicating with said tapchanger control device and determining when said tapswitch is in the neutral position, and d) interface computer program means for sending a close command to said bypass switch, whereby the human can be in a safe place when sending the bypass switch close command.

16. A method of controlling voltages of single phase under load tapchanging voltage regulating apparatus having input and output electrical connections, the method further consisting of the steps of:

a) providing series transformers connected between said input and output connections, b) providing shunt transformers with first transformer winding connections connected to said output connections, c) providing series transformer secondaries with taps capable of causing power to flow in either direction through said regulating apparatus, d) providing tapswitches for interposing between said taps and second winding connections of said series transformer, and e) controlling selection of said taps so as to select tap positions that produce desired voltages at said input and output connections.

* * * * *